US005426441A

United States Patent [19]

Kapitsyn et al.

[11] Patent Number: 5,426,441

[45] Date of Patent: Jun. 20, 1995

[54] PLANAR SLOT ANTENNA GRID

[75] Inventors: Alexandr P. Kapitsyn; Vladimir S. Baev; Alexandr I. Khudysh, all of Ryazan, Russian Federation

[73] Assignee: Aktsionernoe Obschestvo Otkrytogo Tipa Zavod "Krasnoe Znamy", Ryazan, Russian Federation

[21] Appl. No.: 119,076

[22] PCT Filed: Mar. 25, 1991

[86] PCT No.: PCT/SU91/00048

§ 371 Date: Sep. 15, 1993

§ 102(e) Date: Sep. 15, 1993

[87] PCT Pub. No.: WO92/16982

PCT Pub. Date: Oct. 1, 1992

[51] Int. Cl.[6] ..... H01Q 13/10

[52] U.S. Cl. ..... 343/771

[58] Field of Search ..... 343/700 MS, 770, 771; H01Q 1/38, 13/00, 13/10

[56] References Cited

U.S. PATENT DOCUMENTS 4,243,990 1/1981 Nemit et al. ..... 343/770

4,851,855 7/1989 Tsukamoto et al. ..... 343/700 MS

FOREIGN PATENT DOCUMENTS 0089084 9/1983 European Pat. Off. .

0342175 11/1989 European Pat. Off. .

OTHER PUBLICATIONS

Microwave Radio Engineering Express Information Nos. 32 and 25, 1989.

*Primary Examiner*—Michael C. Wimer

*Attorney, Agent, or Firm*—Keck, Mahin & Cate

[57] ABSTRACT

A planar slot antenna grid contains a number of waveguide-slot radiators having wide reverse side and wide outer side faces in which there are obtained, respectively, exciting slots of coupling and radiating slots. The faces lie correspondingly in two parallel planes, and a waveguide-feeder network is formed by waveguide distributors of power and feeding waveguides. Channels of the waveguides communicate with the exciting slots of coupling. The waveguide-slot radiators represent strip-line waveguides including a common dielectric substrate. The reverse side of the substrate is covered by a metallized coating serving as a common wide reverse side face of the waveguide-slot radiators. Each wide outer side face of the radiators represents a strip-line made of alternating narrow and wide segments formed on the outer side face of the dielectric substrate.

3 Claims, 1 Drawing Sheet

PLANAR SLOT ANTENNA GRID

FIELD OF INVENTION

This invention relates to radio engineering, microwave technology antenna-feeder devices, and, more specifically, to a planar slot antenna grid.

PRIOR ART

Work is currently under way on creating antennas of microwave design which would be compatible with modern radio-electronic equipment and ensure an efficiency factor above 0.7 at apertures lying within 15 to 30 wave lengths in free space, and at a working frequencies range of not less than 10%. Apart from that, these antennas should be simple in construction and have small mass/weight and thickness. They should have high manufacturabilty and replication or recurrence of dimensions or parameters.

Attempts to make antennas with said characteristics have materialized in the creation of a slot antenna grid of a printed circuit design ("Radio-Electronics Abroad", Summary, Publication 7(39), 1989 [SRIER, Moscow, "Planar Antennas for Direct TV Broadcasting Systems", pp. 3, 4, FIG. 1]). This slot antenna grid contains a dielectric substrate with wide slot-windows communicating with a waveguide-feeder network formed by strip-lines.

Since the slot antenna grid is obtained in its printed circuit design, it is adaptable to streamlined manufacture, is simple in construction, has small mass/weight and thickness, and high replication of dimensions and parameters.

However, the antenna grid exhibits comparatively big losses in the waveguide-feed network, and both at an aperture size lying within 15 to 30 wave lengths in free space and at working frequencies range of not less than 10%, its efficiency factor does not exceed 0.6. This is conditioned by the fact that the waveguide-feeder network of this antenna grid is produced on strip-lines exhibiting losses within the range of 0.05 to 0.1 d.b./cm.

Known in the prior art also is a waveguide-slot antenna grid on hollow or cored waveguides (D. I. Voskresenski et al. "Antennas & Microwave Devices.-Designing Phased Antenna Grids", 1981, Radio and Communication, Moscow, pp. 126–128). In this antenna grid, waveguide-slot radiators and waveguide-feeder network are obtained on hollow metallic waveguides.

Under the above conditions, the slot antenna grid of this kind provides a high efficiency factor which is due to the fact that the losses in the waveguide-slot radiators and the waveguides of the waveguide-feeder network are minimal and do not exceed 0.001 d.g./cm.

Such construction of the antenna grid is, however, not easily manufacturable because its manufacturing involves a lot of unprogresive mechanical assemblage which does not provide required replication of dimensions and parameters of the antenna grid. Apart from that, the employment of hollow metallic waveguides results in that this antenna grid has large mass/weight and thickness, and a high level of metal consumption.

Known in the prior art is also a slot antenna grid ("Radio-Electronics Abroad", Summary, Publication 2(34), 1989, [SRIER, "Planar Waveguide-Slot Antenna Grids", pp. 24–26, FIG. 2]), containing a number of waveguide-slot antenna radiators having wide reverse and outer side faces in which there are obtained, respectively, exciting slots of coupling and radiating slots. The faces lie correspondingly in two parallel planes, and a waveguide-feeder network containing waveguide distributors of power and feeding waveguides is also obtained channels of which are communicating with the exciting slots of coupling.

Every waveguide-slot radiator is formed as a result of plate assembly manufactured from a metal sheet with radiating slots obtained in it. The plate representing a wide outer side face of this radiator has a base in which, under the waveguide of each waveguide-slot radiator, a rectangular groove is obtained with formation of two narrow side faces and one wide reverse side face of this waveguide-slot radiator. The waveguide-feeder network is made on hollow metallic waveguides.

Under above conditions, such a planar slot antenna grid demonstrates high efficiency factor owing to the fact that the losses in the waveguides of the waveguide-slot radiators and the waveguides of the waveguide-feeder network are minimal.

In practice, however, the manufacturing of such planar slot antenna grids reveals that its construction is complex, and the manufacturing of this antenna grid is labour consuming and not easily adaptable because it involves a lot of unprogressive mechanical assemblage which does not provide a high level of replication of dimensions and parameters of this antenna grid. Apart from that, in the process of making the waveguide-slot radiators, it is difficult to test or run a check on an internal seam or joint between the ribs of the narrow side faces of the waveguides obtained at the base, and the metal sheet with radiating slots. The presence of even a short segment which is not caulked by soldering, in these joints, results in spurious or stray coupling between the adjacent waveguide-slot radiators and, consequently, reduces a gain factor of the antenna grid. In other words, the construction of the present planar slot antenna grid is unreliable. Apart from that, such an antenna grid has greater mass/weight and thickness than that of the antenna grids produced according to the printed circuit design. Mainly, this is conditioned by the fact that the construction of the present grid employs the metallic base under the waveguides of the waveguide-slot radiators, the base having greater mass/weight and thickness. The employment of the waveguide-feeder network on the hollow metallic waveguides is responsible for, even greater increase in mass/weight and thickness of this antenna grid.

SUMMARY OF THE INVENTION

The invention addresses the problem of creating a planar slot antenna grid in which, owing to constructive design modifications of the waveguide-slot radiators, while maintaining a high efficiency factor within a wide range of frequencies, simplicity and reliability of construction, as well as smaller thickness and weight, and higher manufacturabilty of this antenna grid, are ensured.

This problem is solved, in a planar slot antenna grid containing a number of waveguide-slot radiators having wide reverse side and outer side faces, in which there are obtained, respectively, exciting slots of coupling and radiating slots, by having the faces lying correspondingly in two parallel planes. A waveguide-feeder network contains waveguide distributors of power and feeding waveguides, channels of which communicate with the exciting slots of coupling. According to the invention, the waveguide-slot radiators represent strip-line waveguides comprising a common dielectric substrate, the reverse side of which is covered by metallized coating serving as a common wide reverse side face of the waveguide-slot radiators, each outer side face of which representing a strip line made of alternating wide and narrow segments formed on outer side face of the dielectric substrate.

Construction of the waveguide-slot radiators is designed essentially as the printed circuit dielectric substrate. On one side, there is placed a number of wide outer side faces of the printed circuit strip-line waveguide-slot radiators in the form of strip-lines of alternating wide and narrow segments, and on the other side, there is obtained a common wide reverse side face of these strip-line waveguide-slot radiators in the form of metallized coating.

Construction of such an antenna grid offers the possibility to manufacture waveguide-slot radiators of the printed circuit design. In other words, the construction permits one to abandon a lot of mechanical assemblage and to introduce progressive methods of the printed circuit technology, specifically, by means of photolithography. This makes the antenna grid adaptable to streamlined manufacture with reduced labour consumption.

Apart from that, the employment of printed circuit technology in making the antenna grid allows a high level of replication of dimensions and parameters of the antenna grid to be obtained.

Construction of the present planar slot antenna grid provides for the execution of the waveguide-slot radiators as a single unit member, i.e. the dielectric plate with wide outer side faces of the printed circuit waveguide-slot radiators on the one side and a thin metallized coating on the other side. Thickness and mass/weight of such a member are small, and its construction is simple and reliable. The antenna grid also has small mass/-weight and thickness, and its construction is simple and reliable.

The proposed planar slot antenna grid reveals a high, above 0.7, efficiency factor at apertures lying within 15 to 30 wave lengths in free space, and at working frequencies of not less than 10%. This is conditioned by the fact that the waveguide-slot radiators of this antenna grid are produced on the strip-line waveguides representing basically the waveguides of rectangular section filled in with the dielectric material of which the substrate is made. Losses in such strip line waveguides are within 0.02 to 0.03 d.g./cm, which does not substantially reduce the efficiency factor of the antenna grid.

It is advisable to place the waveguide-feeder network and on the metallized coating which represents a common wide side face of the feeding waveguides and the waveguide distributors of power.

Thus, it becomes possible to simultaneously use the metallized coating of the substrate both as wide reverse side faces of the strip-line waveguide-slot radiators and as one of the wide side faces of the waveguides of the waveguide-feeder network. This, in turn, permits to a reduction in thickness and mass/weight of the antenna grid.

Similarly, it is advisable that the waveguide-feeder network has a base in which there are obtained rectangular grooves having surfaces which, together with the metallized coating surface, would create channels of the waveguide-feeder network.

This construction makes it possible to obtain, after the radiator substrate is assembled with the base of the waveguide-feeder network, the waveguides of rectangular section on which the feeding waveguides and the waveguide distributors of power in the form of, for example, H-tee are easily realized. This offers the possibility of making all waveguides of the waveguide-feeder network lie in one plane, and reduces a thickness of the antenna grid.

It is recommended that longitudinal axes of the strip-line wave-guides are parallel to each other, that a distance between longitudinal axes of the adjacent strip-line waveguides be less than a wave length in free space at higher frequency, and that the distance be more than 1/20 value of this wave length with lateral width of the wide segment of a strip-line.

This allows one to achieve maximum gain factor of this antenna grid. Selection of distance between longitudinal axes of the adjacent strip-line waveguides to be less than 1/20 wave length in free space at a higher frequency with lateral width of the wide segment of a strip-line results in spurious coupling between the adjacent strip-line waveguides and reduces a gain factor of the antenna grid. On the other hand, if the distance is greater than wave length in free space at higher frequency, diffraction lobes, which also reduce gain factor of the antenna grid, appear.

It is advisable also that length of every exciting slot of coupling is within the range of about 0.8 to 1.0 times the lateral width of the narrow segment of a strip-line.

This ensures maximum efficiency and, consequently, a gain factor of the antenna grid. On one hand, making the length of every slot be less than 0.8 times the lateral width of the narrow segment of a strip-line, does not permit one to obtain sufficient coupling between the waveguide-slot radiators on strip-line waveguides with feeding waveguides of the waveguide-feeder network. On the other hand, making each slot be more than 1.0 times the lateral width results in spurious radiation from the strip-line waveguide, which causes losses and reduces the efficiency factor of this antenna grid.

BRIEF DESCRIPTION OF THE DRAWINGS

The present invention will become more fully apparent from an description of the embodiment of the planar slot antenna grid illustrated by the accompanying drawings, wherein.

BEST METHOD OF CARRYING OUT THE INVENTION

Figure 1:
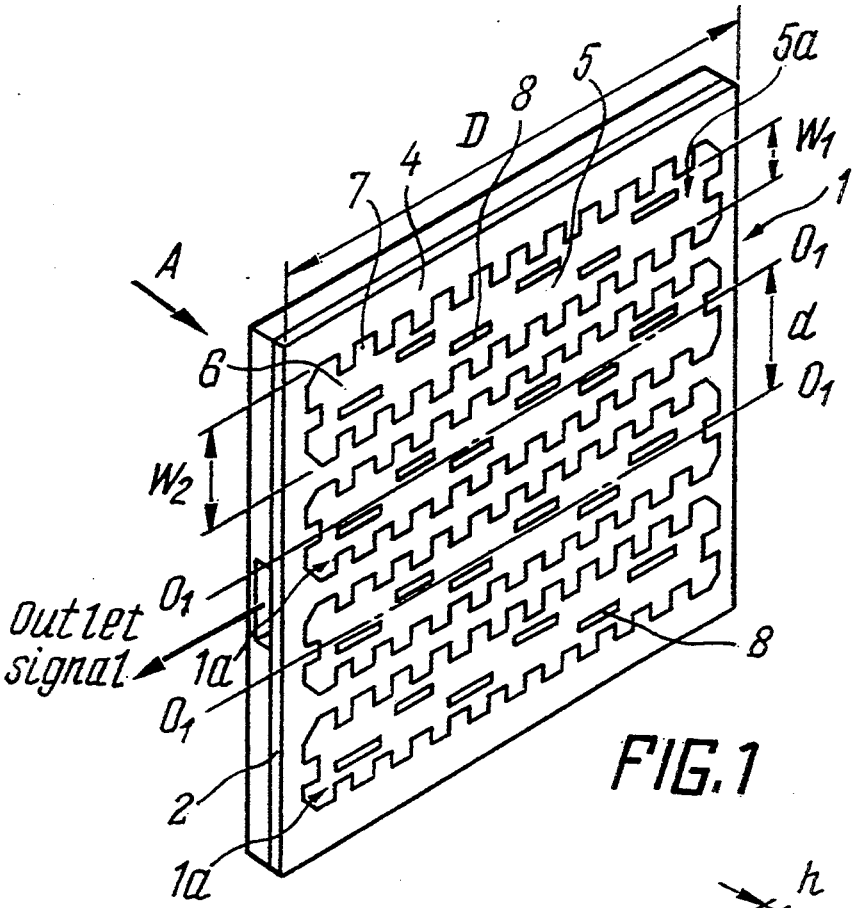
FIG. 1 is a representation of the planar slot antenna grid, drawn in rectangular isometric projection, according to the invention.
Figure 2:
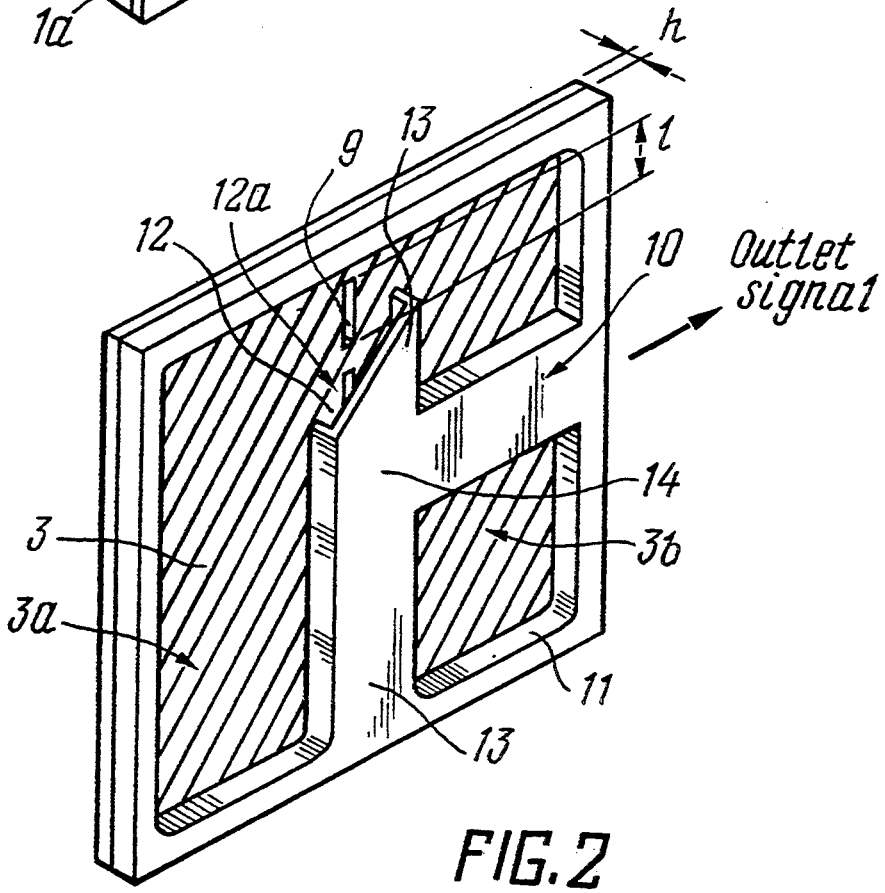
FIG. 2 is a view in the direction indicated by arrow A of FIG. 1.

Below we describe a planar slot antenna grid employed as an antenna for direct satellite telecasting systems. This antenna grid contains a number of waveguide-slot radiators 1 (FIG. 1), each radiator representing a strip-line waveguide 1*a*, comprising a dielectric substrate 2, the reverse side face of which is covered by metallized coating 3 (FIG. 2) serving as a common wide reverse side face 3a of the waveguide-slot radiators 1. On the outer side face 4 (FIG. 1) of the dielectric substrate 2, there is formed a number of strip lines 5. Each strip-line represents a wide outer side face 5*a* of the waveguide-slot radiator 1 and comprising alternating narrow segments 6 and wide segments 7. In the wide outer side face 5*a* of the waveguide-slot radiator 1, there are obtained the radiating slots 8. In the common reverse side face 3*a*, there are obtained the exciting slots 9 (FIG. 2) of coupling. The common reverse side face 3*a* and the wide outer side faces 5*a* of the waveguide-slot radiators 1 lie in parallel planes. On the metallized coating 3, there is placed a waveguide-feeder network 10 comprising a base 11 with rectangular grooves 12 having surfaces having together with the metallized coating surface create channels 12*a* of the feeding waveguides 13 and waveguide distributors 14 of power produced in the form of H-tees. The metallized coating 3 is a wide side face 3*b* of the feeding waveguides 13 and waveguide distributors 14 of power. Length (1) of each exciting slot 9 of coupling lies within the range of about 0.8 to 1.0 lateral width W1 (FIG. 1) of the narrow segment 6 of the strip-line 5. Longitudinal aces O—O of the strip-line waveguides 1*a* are parallel to each other, and distance d between longitudinal axes O1—O1 of the adjacent strip-line waveguides 1*a* is less than a wave length in free space at higher frequency and more than 1/20 of this wave length with lateral width W2 of the wide segment 7 of the strip-line 5. A quantity of the waveguide-slot radiators 1, radiating slots 8, feeding waveguides 13 and waveguide distributors 14 of power is selected depending on the required aperture dimension D of the antenna grid and the range of working frequencies.

The antenna grid operates as follows. A signal received by the antenna grid, through the radiating slot 8, comes to every waveguide-slot radiator 1 and extends along longitudinal axis 01—01 of the strip-line waveguide 1*a* as a wave close to an H type. The alternating narrow segments 6 and wide segments 7 of the strip-line 5 form the wide outer side face 5*a* of the strip-line waveguide 1*a*. In the strip-line waveguide 1*a*, the narrow side faces, as elements of construction, are absent. However, the execution of zero boundary conditions for electric field Ey in the planes lying at a distance approximately equal to ½ of width W1 of the narrow segment 6 of the strip-line 5, in relation to longitudinal axis 01—01 of the strip-line waveguide 1*a*, creates conditions for extending the waves of waveguide type in such a line. The wave guide-slot radiator 1 on the strip-line waveguide has the topology of the radiating slots 8 and electricity characteristics close to the topology and electricity characteristics of the waveguide-slot radiators on the hollow metallic wave guide with a wide side face size approximately equal to width W1 of the narrow segments of the strip-lines 5, and with a narrow side face size equal to h thickness of the dielectric substrate 2 and filled in with dielectric material of which the substrate 2 is produced. The signals from each waveguide-slot radiator 1 on the strip-line waveguides 1*a*, the radiator representing essentially a resonant or non-resonant waveguide-slot antenna grid on a rectangular waveguide filled in with dielectric material, come through the exciting slots 9 of coupling to the feeding waveguides 13, and through the slots 9, they extend in the waveguide distributors 14 of power in which there takes place an in-phase (through the same angle) signal interference and formation of an output signal. The quantity of the feeding waveguides 13 and waveguide distributors 14 of power in the antenna grid is determined by the aperture dimensions D and the required range of transmission.

INDUSTRIAL APPLICABILITY

The planar slot antenna grid of the present invention which is utilized for the purpose of direct satellite telecasting, at aperture dimensions of 375×375 mm and thickness of 8 mm, reveals 0.75 efficiency factor and 32.9 d.g. gain factor within the range of 10.9 to 11.7 GHz working frequencies. The antenna grid of the same construction, having dimensions of 750×750 mm and thickness of 30 mm, has 0.72 efficiency and 38.8 d.g. gain factor within the same range of frequencies.

We claim:

1. A planar slot antenna grid comprising:

a dielectric plate having a face side and a back side;

a plurality of strip lines disposed on said face side of the dielectric plate, each of said strip lines including a strip, having a longitudinal axis, and a plurality of regular stubs disposed symmetrically on both sides of the strip;

a plurality of radiating slots provided in said strip;

a layer of metal applied to said back side of the dielectric plate;

a plurality of exciting slots provided in said layer of metal opposite to an appropriate one of said strips and at an angle to the longitudinal axis thereof;

a strip line of said plurality of strip lines, with one said strip provided with radiating slots, and a section of said layer of metal arranged to be disposed opposite to an appropriate one of said strip lines on said dielectric plate provided together in each of a plurality of waveguide-slot radiators; and power supply means for supplying power to the slot antenna grid, said power supply means being electrically connected with appropriate exciting slots.

2. A planar slot antenna grid according to claim 1, wherein said power supply means comprises:

a base, in which a plurality of channels is provided, disposed on said layer of metal;

a second layer of metal applied to a surface of said plurality of channels; and feeding waveguides and waveguide distributors of power made as H-tees and formed by said surface of said plurality of channels and said layer of metal applied to the back side of the dielectric plate;

said feeding waveguides being disposed opposite to said exciting slots.

3. The planar slot antenna according to claim 1, wherein radiators are parallel, the distance between longitudinal axes of adjacent waveguide-slot radiators being determined from the following inequality:

$$W2+0.05Lb<d<Lb,$$

wherein Lb is a wavelength, in free space, at an upper frequency of a working band, W2 is a lateral dimension of the strip line together with two of said stubs; and d is the distance between the longitudinal axis.

* * * * *